US006157728A

United States Patent [19]

Tong et al.

[11] Patent Number: 6,157,728

[45] Date of Patent: Dec. 5, 2000

[54] UNIVERSAL SELF-ATTACHING INDUCTIVE COUPLING UNIT FOR CONNECTING HEARING INSTRUMENT TO PERIPHERAL ELECTRONIC DEVICES

[75] Inventors: Yit Chow Tong; Joseph Sylvester Chang, both of Singapore, Singapore

[73] Assignee: Multitech Products (PTE) Ltd., Singapore, Singapore

[21] Appl. No.: 09/180,802

[22] PCT Filed: May 23, 1997

[86] PCT No.: PCT/SG97/00021

§ 371 Date: Nov. 16, 1998

§ 102(e) Date: Nov. 16, 1998

[87] PCT Pub. No.: WO97/46050

PCT Pub. Date: Dec. 4, 1997

[30] Foreign Application Priority Data

May 25, 1996 [SG] Singapore ..... 9609892

[51] Int. Cl.[7] ..... H04R 25/00

[52] U.S. Cl. ..... 381/331; 381/60; 381/23.1; 381/323

[58] Field of Search ..... 381/60, 23.1, 314, 381/315, 322, 323, 324, 326, 331

[56] References Cited

U.S. PATENT DOCUMENTS

| | | | |
|---|---|---|---|
| 3,659,056 | 4/1972 | Morrison et al. | 381/331 |
| 4,489,330 | 12/1984 | Marutake et al. | 381/331 |
| 4,827,524 | 5/1989 | Rising | 381/60 |
| 5,010,575 | 4/1991 | Marutake et al. | 381/331 |
| 5,217,011 | 6/1993 | Bisch | 381/331 |

*Primary Examiner*—Curtis A. Kuntz
*Assistant Examiner*—Suhan Ni
*Attorney, Agent, or Firm*—Lawrence V. D. Ho; David D. Chung; Jacqueline C. T. Lui

[57] ABSTRACT

An inductive coupling unit which can be easily attached to any hearing instrument with an internal receiving coil to connect the instrument to peripheral electronic devices. The coupling unit includes a head including a head cover, a bobbin disposed inside the head cover, a transmitting coil which is wrapped around the bobbin, and a cylindrical magnet placed in the center of the bobbin. An end of a conductive cable is connected to the transmitting coil and the other end is connected to a plug which makes electrical connection with a peripheral device. The coupling unit is placed on the outer surface of the hearing instrument, and the signals from the peripheral device are induced in the receiving coil of the hearing instrument by the transmitting coil to provide clear, high fidelity transmission.

7 Claims, 5 Drawing Sheets

UNIVERSAL SELF-ATTACHING INDUCTIVE COUPLING UNIT FOR CONNECTING HEARING INSTRUMENT TO PERIPHERAL ELECTRONIC DEVICES

FIELD OF THE INVENTION

This invention relates to an interfacing device, and particularly to an inductive coupling unit for effecting signal transmission between hearing instruments and peripheral electronic devices, the coupling unit being easily attachable to the outer surface of the hearing instrument without requiring specially-designed input pads or adapters.

BACKGROUND OF THE INVENTION

Wearers of hearing instruments such as hearing aids sometimes have the need to directly connect the hearing instrument to peripheral electronic devices such as radios, television sets, telephones, etc. The reasons may be to improve the quality of reception, to gain privacy, or to avoid disturbing others. In FIG. 1, a typical currently-available interfacing adapter 4 is illustrated along with a hearing instrument 1 with switch 2 set to the 'M' (microphone position), and a male plug 6 which connected via a cable 7 to a peripheral device (not shown). To couple the hearing instrument 1 to the peripheral device using this adapter 4, the hearing instrument 1 must have special input pads 3 such as the ones shown in FIG. 1. As illustrated in FIG. 1, these pads 3 are necessary to receive and make contact with the input connectors 5 disposed in the adapter 4, which in turn receive the plug 6 which is connected to the peripheral electronic device.

This type of connection suffers from a number of shortcomings. For one, it is not adaptable for all types of hearing instruments because the hearing instrument must have these specially-designed input pads to receive the input connectors of the interfacing adapter. Note that the input pads must be directly connected to the amplifier of the hearing instrument which is usually located deep inside the hearing instrument. Therefore, the existing hearing instrument wearers who do not have the special input pads in their hearing instrument cannot be connected to the peripheral devices. Simply stated, the existing interfacing adapter is not universally adaptable. Not only does this type of connection create problems for the wearers who do not have these input pads, the pads impose an additional design constraint to manufacturers of the hearing instruments.

Furthermore, this type of interfacing adapter is cumbersome to use because the adapter must be positioned precisely so that the input connectors mate properly with the input pads of the hearing instrument. The input pads must also be kept clean to facilitate a good electrical contact. Hence the user may have to remove the hearing instrument from the ear to make the connection, or in the minimum, expend unnecessary time and effort to mate the connectors to the input pads. While this may not be a monumental task for some people, it can be a vexing problem for children, elderlies, and other people with disabled or undeveloped dexterity.

Moreover, this interfacing adapter and the hearing instrument that it is attached to can be damaged if the wearer, particularly a child, inadvertently jerks on the cable because the interfacing adapter does not easily disengage from the hearing instrument from all angles. So if someone inadvertently pulls the cable in a direction perpendicular to the direction of the insertion, the cable and the adapter may break off from the instrument, or the hearing instrument may be dislodged from the user's ear and drop to the ground. In either case, a possibility of damage exists.

Hence, it would be highly desirable to have a coupling device which can accommodate virtually all types of existing hearing instruments without needing any significant modification, and which can be easily attached and removed by hearing instrument wearers with even poor dexterity.

OBJECT OF THE INVENTION

It is therefore the object of this invention to overcome the shortcomings stated above, and to provide a coupling unit which can accommodate virtually all types of hearing instruments, and which can easily be attached and removed without special adapters.

SUMMARY OF THE INVENTION

The present invention is an inductive coupling unit which can be easily attached to any hearing instrument with an internal receiving coil to connect the instrument to peripheral electronic devices. The coupling unit includes a head including a head cover, a bobbin disposed inside the head cover, a transmitting coil which is wrapped around the bobbin, and a cylindrical magnet placed in the center of the bobbin. An end of a conductive cable is connected to the transmitting coil and the other end is connected to a plug which makes electrical connection with a peripheral device. The coupling unit is placed on the outer surface of the hearing instrument, and the signals from the peripheral device are induced in the receiving coil of the hearing instrument by the transmitting coil to provide clear, high fidelity transmission.

DETAILED DESCRIPTION OF THE INVENTION

Figure 1:
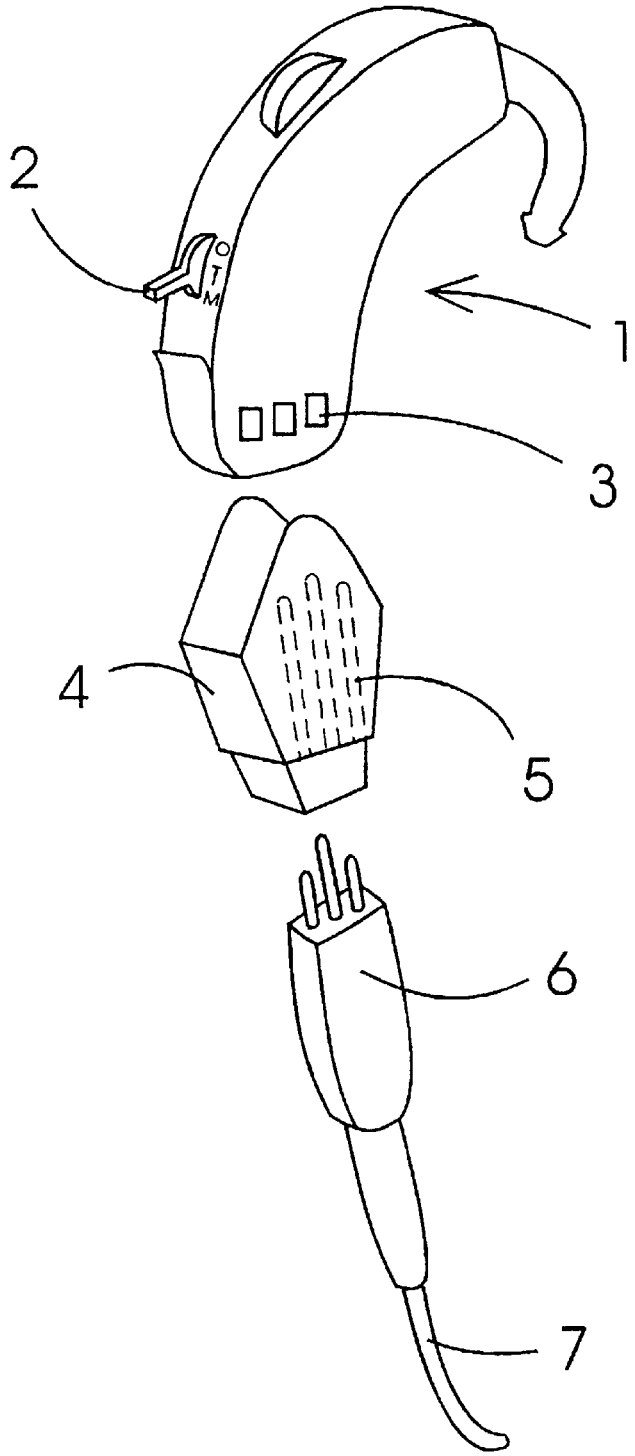
FIG. 1 (Prior Art) is a perspective diagram illustrating the prior art interfacing adapter for connecting hearing instruments to electronic peripheral devices.
Figure 2A:
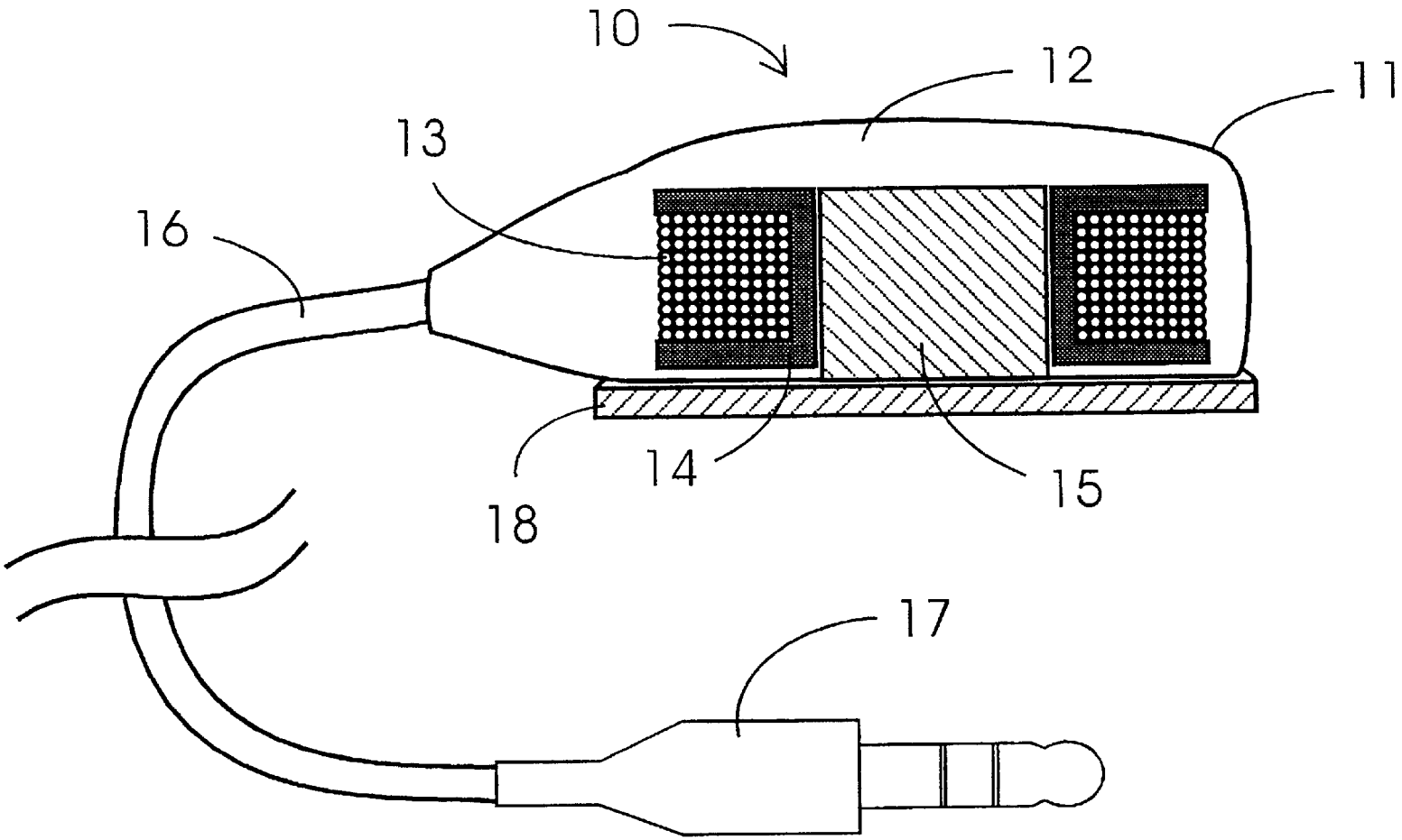
FIG. 2A is an elevational sectioned diagram of the preferred embodiment of the present invention.

The present invention is an inductive coupling unit which can be easily attached to any hearing instrument with an internal receiving coil to connect the hearing instrument to peripheral electronic devices. FIG. 2A is a detailed illustration of the preferred embodiment of the present invention. The coupling unit 10 includes a head portion 11 a cable 16, and a plug 17 or a similar adapter which can provide electrical connection with a peripheral electronic device. The head 11 includes a head cover 12. A bobbin 14 is firmly placed inside the head cover 12 with a transmitting coil 13 wrapped around it. Placed in the center of the bobbin 14 is a cylindrical magnet 15, with one end exposed on the bottom side of the head cover 12 such that it and the ferromagnetic plate 18 can be joined together by their magnetic attractive forces.

Figure 2B:
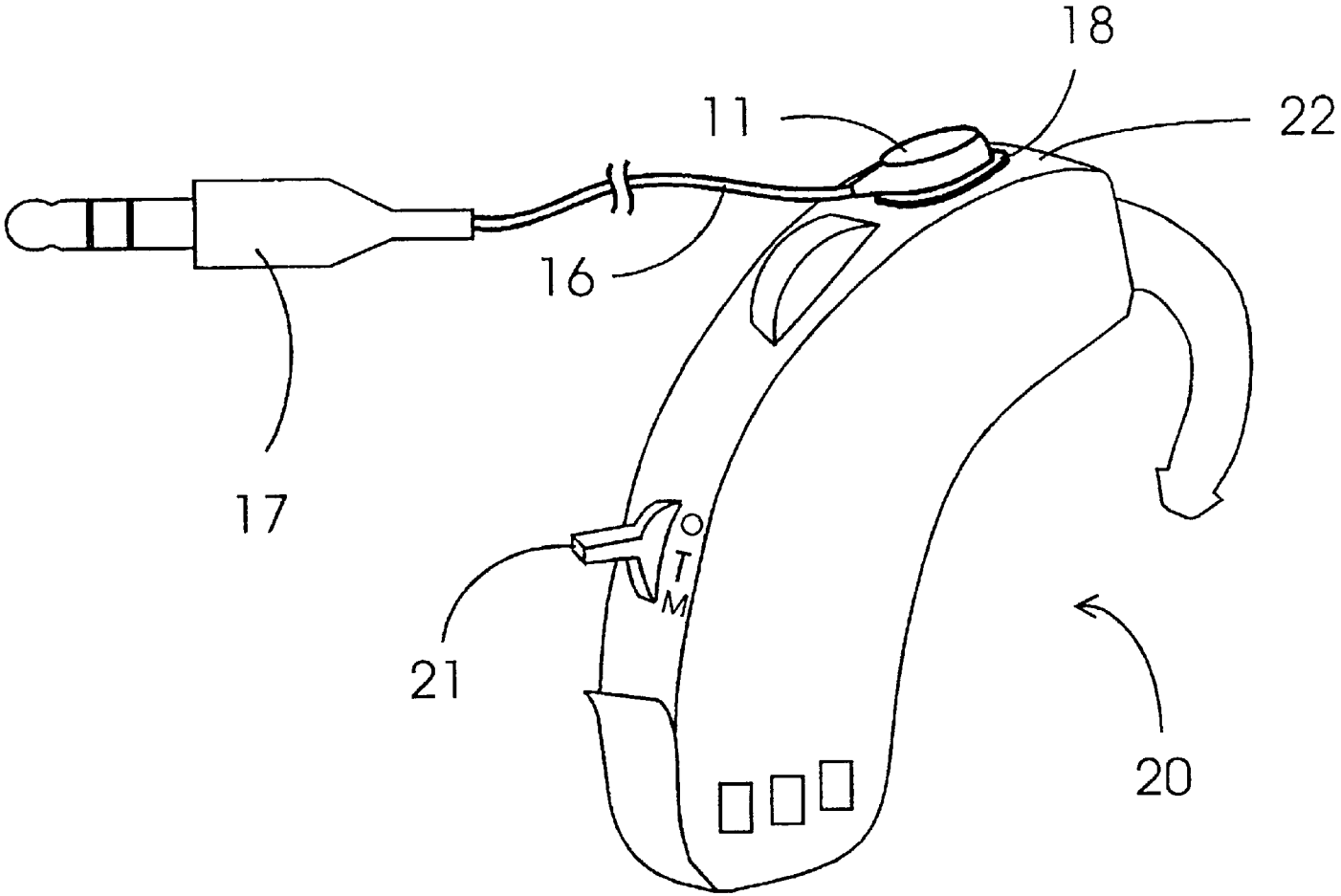
FIG. 2B is an elevational view of the invention shown in FIG. 2A magnetically attached to the outer surface of a hearing instrument.

As illustrated in FIG. 2B, the ferromagnetic plate 18 is attached to the outer surface 22 of the hearing instrument 20. It can be attached permanently using strong bonding agents or temporarily using double sided tapes or non-setting adhesives. The location of the plate is not essential to the function of the coupling unit except that it should be located somewhere convenient to the wearer of the hearing instrument. The switch 21 is set to 'T' (telecoil) position to enable the hearing instrument to pick up signals from its internal receiving coil (not shown). Although in the preferred embodiment the plate 18 is supplied as a component of the coupling unit, it is entirely possible that the plate be omitted if in the future a ferromagnetic plate or a metal plate is integrated with the hearing instrument, either inside or outside, as a permanent fixture.

Figure 3:
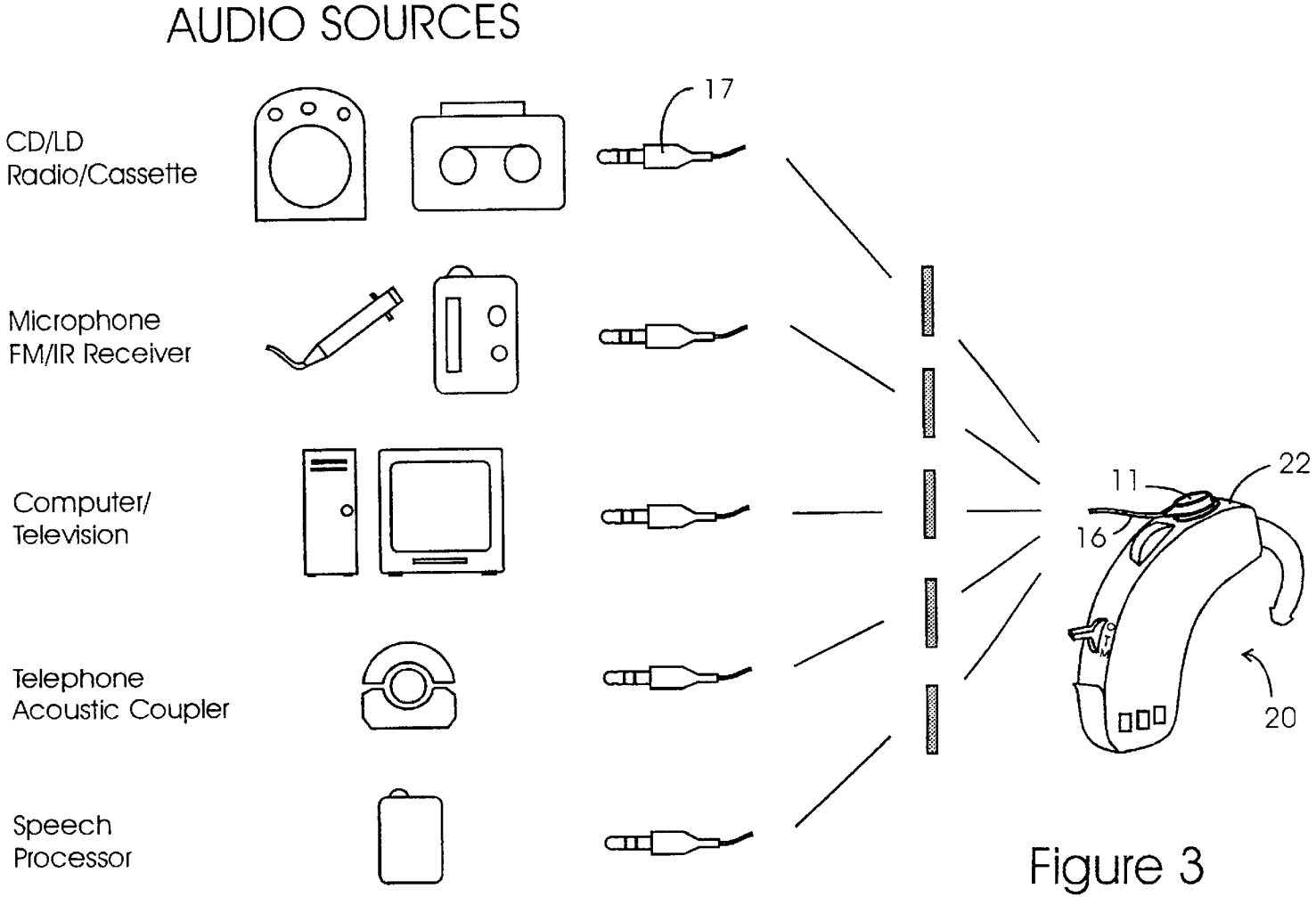
FIG. 3 is a perspective view of the present invention magnetically attached to a hearing instrument and electrically connected to a number of peripheral electronic devices.

In the prior art interfacing devices of the type described in the background portion, the input pads had to make electrical connection with the amplifier input of the hearing instrument. In the present invention, however, no direct connection to the amplifier is necessary because the signals are electromagnetically induced in the receiving coil of the hearing instrument. As can be seen in FIG. 3, the head 11 of the coupling unit 10 rests on the surface 22 of the hearing instrument 20 and can be connected, using a cable 16 and a plug 17, to most peripheral electronic devices such as a radio, microphone, cassette player, computer or television, telephone, speech processor, and etc. The receiving coil (not shown) located inside the hearing instrument 20 is electromagnetically induced by the signal from the coupling unit 10. This signal is subsequently sent to amplifier with switch 21 set to the 'T' position.

This receiving coil inside the hearing instrument was originally designed to receive electromagnetic signals from distant sources, and was not used or intended to be used in the manner employed by this invention. In practice, however, it was seen that this receiving coil was not ideally suited to receive distant signals, as the signals tended to be very uneven and consequently the reception was somewhat poor. The quality of the reception is greatly improved with the current invention.

Figure 4:
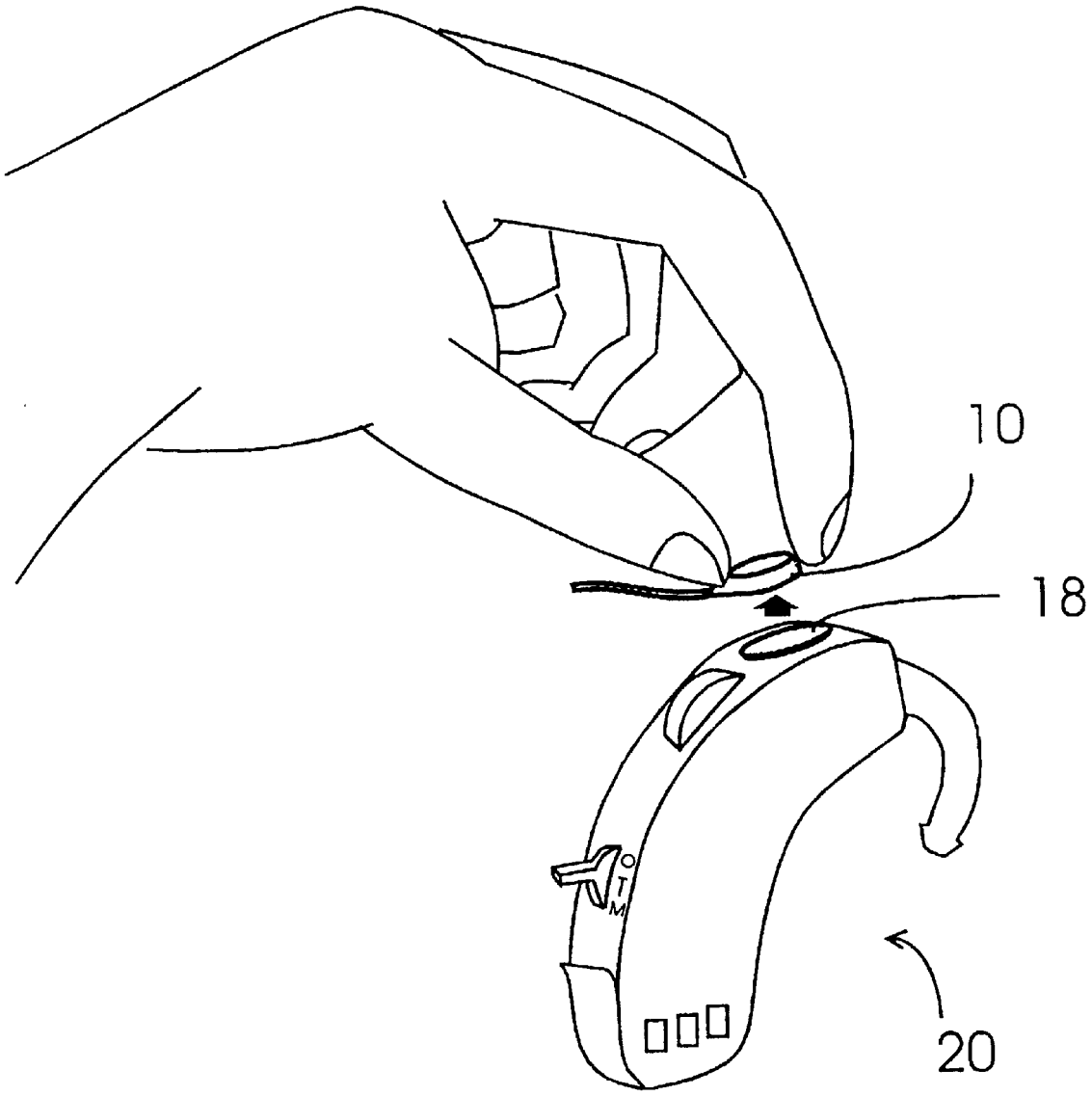
FIG. 4 is a perspective view illustrating the removal of the coupling unit from the hearing instrument.

This coupling unit has many advantages over the existing interfacing adapter as described in the Background portion. It can be easily attached to any existing hearing instrument which has a receiving coil. Virtually all current hearing instruments have a receiving coil. Hence, the coupling unit is virtually universally adaptable. Moreover, once the ferromagnetic plate is put in place, the coupling unit can be easily attached to and removed from the hearing instrument as illustrated in FIG. 4. This feature is particularly important to hearing instrument wearers who are very young, very old, or disabled. In addition, it is virtually childproof as a jerk in the cable would cause the unit to disengage itself without causing the entire hearing instrument to come off the wearer's ear.

It should be understood to those skilled in the art that though the preferred embodiment has been shown here as a way of teaching the best way to make and use the invention, various modifications can be made to fit the needs or preferences of the user or the manufacturer. For instance, though the preferred embodiment showed a bobbin to support the transmitting coil, the coil may be wrapped around the cylindrical magnet directly. In addition, although it is preferred that magnetic attractive force be used to attach the coupling unit head to the hearing instrument, the head may be attached by other means such as reusable adhesives, clips, hooks, friction joints, etc., so long as the attaching means can facilitate easy attachment and removal of the coupling unit to the hearing instrument. Of course, for these cases, the cylindrical magnet and ferromagnetic plate may be eliminated. Hence, various modifications, additions and substitutions are possible for the invention described herein, without departing from the scope and spirit of the invention as disclosed in the accompanying claims.

We claim:

1. A universal self-attaching inductive coupling unit for connecting a hearing instrument to peripheral electronic devices, said hearing instrument having a receiving coil and an outer surface, said coupling unit comprising:

a head including a head cover;

a bobbin firmly disposed inside said head;

a transmitting coil wrapped around said bobbin;

a magnet firmly disposed inside said head;

a conducting cable connected to said transmitting coil at an end;

a plug connected to said cable at an end opposite to the end connected to said transmitting coil, said plug adapted for electrically interfacing with said peripheral electronic devices;

a ferromagnetic plate adapted for being firmly attached to the outer surface of said hearing instrument;

whereby said magnet disposed inside said head cover is easily attached and removed from said ferromagnetic plate, and said receiving coil is electromagnetically induced by said transmitting coil to receive electrical signals from said peripheral devices when said magnet is attached to said plate.

2. The inductive coupling unit as recited in claim 1 wherein said ferromagnetic plate is attached to the outer surface of said hearing instrument by an adhesive.

3. The inductive coupling unit as recited in claim 1 wherein said ferromagnetic plate is an integrated component of said hearing instrument.

4. The inductive coupling unit as recited in claim 1 wherein said magnet is cylindrical in shape and disposed in center of said bobbin.

5. The inductive coupling unit as recited in claim 1 wherein said head cover is made of electromagnetically neutral material.

6. A universal self-attaching inductive coupling unit for connecting a hearing instrument to peripheral electronic devices, said hearing instrument having a receiving coil and a metal plate on an outer surface of the hearing instrument, said coupling unit comprising:

a head including a head cover;

a bobbin firmly disposed inside said head;

a transmitting coil wrapped around said bobbin;

a magnet firmly disposed inside said head;

a conducting cable connected to said transmitting coil at an end; and a plug connected to said cable at an end opposite to the end connected to said transmitting coil, said plug adapted for electrically interfacing with said electronic peripheral devices;

whereby said magnet disposed inside said head cover is easily attached and removed from said metal plate, and said receiving coil is electromagnetically induced by said transmitting coil to receive electrical signals from said peripheral devices when said magnet is attached to said plate.

7. A universal self-attaching inductive coupling unit for connecting a hearing instrument to peripheral electronic devices, said hearing instrument having a receiving coil and a ferromagnetic plate inside the hearing instrument and near an outer surface , said coupling unit comprising:

a head including a head cover;

a bobbin firmly disposed inside said head cover;

a transmitting coil wrapped around said bobbin;

a magnet firmly disposed inside said head cover;

a conducting cable connected to said transmitting coil at an end; and a plug connected to said cable at an end opposite to the end connected to said transmitting coil, said plug adapted for electrically coupling with said electronic peripheral devices;

whereby said magnet disposed inside said head cover is adapted for being easily attached and removed from said outer surface near the ferromagnetic plate, and said receiving coil is electromagnetically induced by said transmitting coil to receive electrical signals from said peripheral devices when said magnet is attached to said outer surface.

* * * * *